United States Patent [19]

Hochstrasser et al.

[11] 4,301,320

[45] Nov. 17, 1981

[54] COOLING OF ELECTRICAL FURNACES

[75] Inventors: Otto Hochstrasser, Franklin Park; William S. Ruby, E. Brunswick; Frank V. Madaffore, N. Brunswick, all of N.J.

[73] Assignee: Brown Boveri Corporation, N. Brunswick, N.J.

[21] Appl. No.: 141,589

[22] Filed: Apr. 18, 1980

[51] Int. Cl.[3] ..... F27D 1/12

[52] U.S. Cl. ..... 13/32; 165/104.14; 165/104.31; 432/233; 13/26

[58] Field of Search ..... 13/26, 9 R, 32; 266/190; 165/107, 13; 176/37, 38; 174/15 R; 366/57; 122/6 A, 6 R; 110/180; 432/233, 237, 238

[56] References Cited

U.S. PATENT DOCUMENTS 3,995,687 12/1976 Euler ..... 165/107

OTHER PUBLICATIONS

Water Systems and Water Treatment for Coreless Induction Furnaces, APS Committee 8C, W. F. Pruywe et al.

*Primary Examiner*—Gene Z. Rubinson
*Assistant Examiner*—Bernard Roskoski
*Attorney, Agent, or Firm*—Fitzpatrick, Cella, Harper & Scinto

[57] ABSTRACT

Emergency cooling for an electric furnace is carried out by flowing municipal water through one part of a heat exchanger and through a hydraulic motor and using the motor output to drive a pump which forces coolant liquid in recirculatory fashion through the furnace and through another part of the heat exchanger.

14 Claims, 6 Drawing Figures

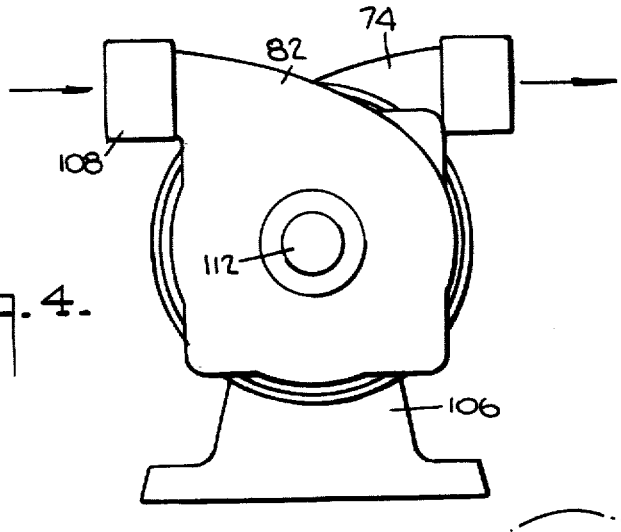
Fig. 4.
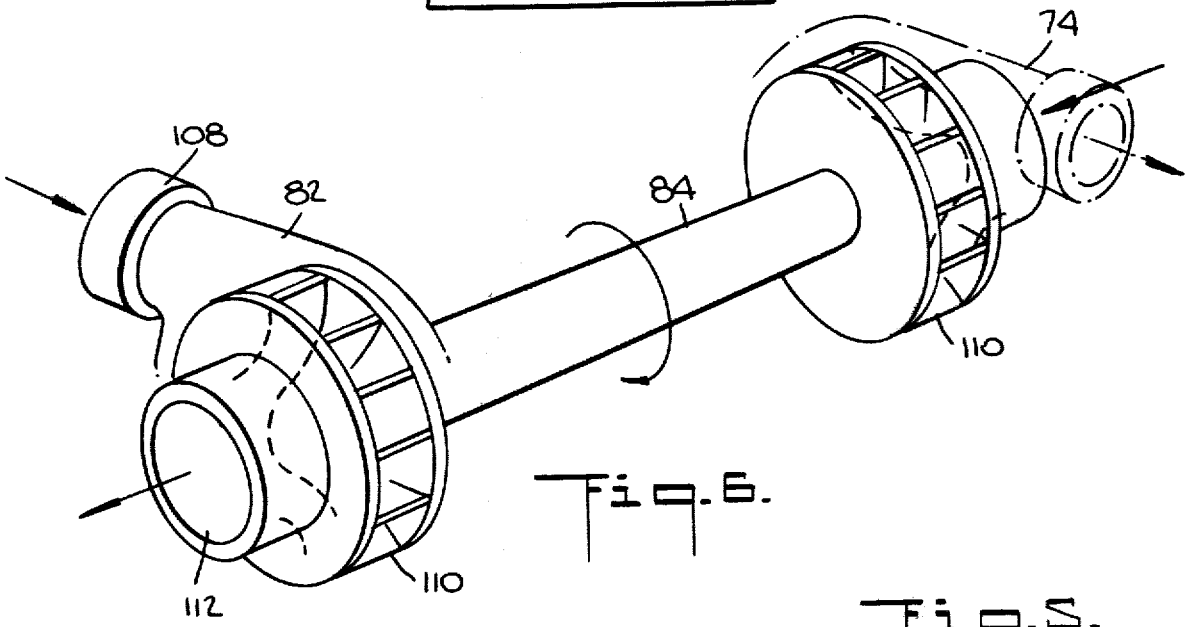
Fig. 6.
Fig. 5.
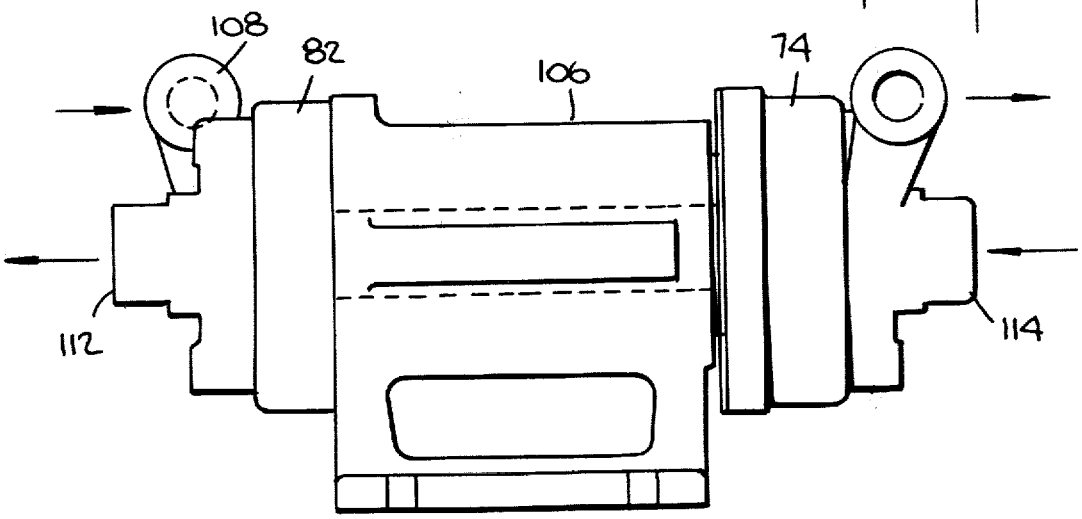

COOLING OF ELECTRICAL FURNACES

BACKGROUND OF THE INVENTION

1. Field of the Invention

This invention relates to the cooling of electrical induction furnaces and more particularly it concerns novel methods and apparatus for providing emergency cooling to such furnaces.

2. Description of the Prior Art

It is known to cool electrical induction furnaces by flowing a primary coolant liquid, such as water, through coils in or around the furnace and then to pass the coolant liquid through a primary heat exchanger for example, an evaporation cooling tower. Cooling systems such as this are shown and described in a publication entitled *Water Systems and Water Treatment for Coreless Induction Furnaces,* published in 1977 as a report of Committee 8C of the American Foundrymen's Society, Incorporated, Des Plaines, Ill.

As further pointed out in the above mentioned publication, the primary coolant liquid is specially treated, for example, demineralized, in order to minimize corrosion and scale buildup in the various coils and passageways through which it flows. In some instances an additive, such as glycol, is provided to avoid freezing when the furnace is shut down during cold weather. These treatments are relatively expensive. Accordingly, in order to maintain the treated condition of the treated coolant liquid, and to avoid the necessity to add substantial amounts of additional liquid, the flow path for the primary coolant liquid is in the form of a closed circuit and the external primary heat exchanger employs indirect heat exchange, that is, the heat from the coolant liquid passes through tube walls to another fluid which does not directly contact the coolant liquid. A recirculating pump is provided along the closed circuit and pumps the primary coolant liquid so that the same liquid recirculates through the furnace, through the indirect primary heat exchanger and back around through the furnace again.

It is necessary to provide an emergency cooling arrangement to prevent overheating of the furnace in the event of a breakdown in the recirculating pump or in the heat exchanger. In the past, the emergency cooling arrangement comprised means to supply an emergency coolant liquid to the system. Usually there was provided an emergency coolant line converted to a municipal water supply which served as a source of emergency coolant liquid. When a breakdown occurred a valve was opened in the emergency coolant line and municipal water was forced by its own pressure into and through the furnace coils; and the emergency coolant liquid, i.e. the municipal water, would force the primary coolant ahead of it and out through a drain.

The emergency cooling system of the prior art was simple and convenient; however it had two disadvantages. Firstly, it resulted in a loss of the primary coolant liquid, which is expensive. Secondly, it also resulted in the furnace cooling system being charged with untreated water, which increased the potential for corrosion and scale buildup.

SUMMARY OF THE INVENTION

The present invention overcomes these problems of the prior art and provides novel and effective arrangements for cooling an electrical furnace in the event of a breakdown in the primary coolant pumping system or in the primary heat exchanger. These novel arrangements, moreover, do not result in loss of the treated primary coolant liquid nor do they expose the primary coolant system to the corrosion and scale producing effects of the emergency coolant.

According to one aspect of the present invention the novel arrangements for emergency cooling as carried out by directing at least a portion of the primary coolant liquid to flow through a bypass conduit to bypass the separate heat exchanger and to pass through a second heat exchanger in the bypass conduit. A pressurized emergency coolant liquid, such as municipally supplied water, is directed through the second heat exchanger; and the flow energy of the emergency coolant liquid is used to drive the primary coolant through the bypass conduit and through the second heat exchanger.

According to another aspect of the invention there is provided, in an electrical furnace cooling system, a bypass conduit for permitting at least a portion of the primary coolant liquid to bypass its primary heat exchanger. A second heat exchanger is interposed in this bypass conduit. An emergency coolant flow conduit is also provided to direct a flow of emergency coolant liquid, e.g. water from a municipal supply, through the second heat exchanger; and means are also arranged to utilize the flow energy of the emergency coolant liquid to drive the primary coolant through the bypass conduit and through the second heat exchanger.

As specifically embodied, the present invention makes use of a fluid motor arranged in the emergency coolant flow conduit and a pump in the bypass conduit. Means, such as a common shaft, are provided between the motor and pump rotors. The flow of emergency coolant liquid through the emergency flow conduit turns the rotor of the motor and this in turn drives the pump rotor. Thus the flow energy of the coolant liquid in the emergency coolant flow conduit is utilized to drive the primary coolant through the bypass conduit and through the second heat exchanger.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein:

FIG. 4 is an end elevation view of a novel turbine-pump assembly used in the furnace cooling system of FIG. 2;

FIG. 5 is a side elevational view of the turbine-pump assembly of FIG. 4; and

FIG. 6 is a perspective view showing a rotor interconnection for the turbine-pump assembly of FIG. 4.

DETAILED DESCRIPTION OF THE PREFERRED EMBODIMENT

Figure 1:
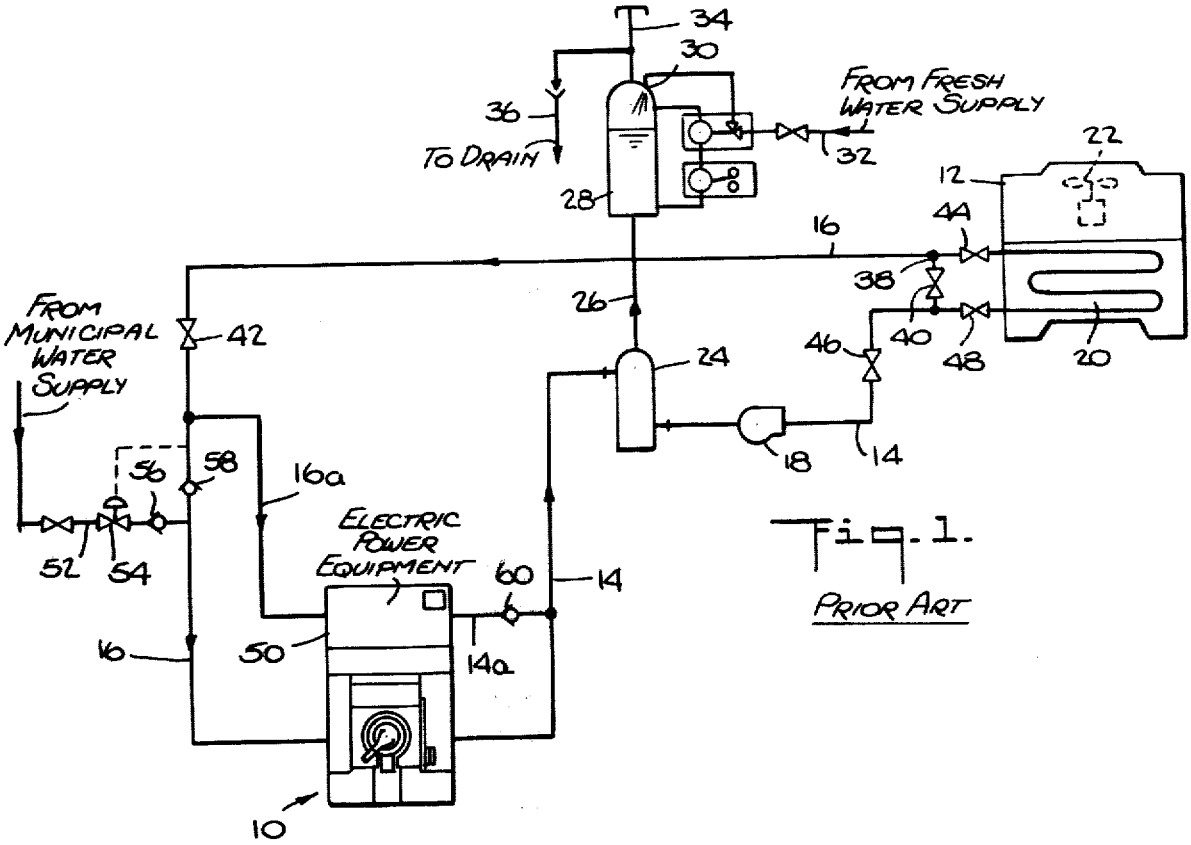
Fig. 1. PRIOR ART
FIG. 1 is a schematic diagram of a furnace cooling system according to the prior art.

The preferred embodiment of the present invention can best be explained by prior reference to a prior art furnace cooling systems as shown in FIG. 1. FIG. 1 shows a conventional induction furnace 10 which is provided with a closed circuit recirculating type cooling system including a primary heat exchanger 12, a coolant outflow line 14 extending between the furnace and the heat exchanger 12 and a coolant return line 16 extending between the heat exchanger and the furnace. A recirculation pump 18 is interposed along the outflow line 14. A primary coolant liquid, such as treated water, fills the system and is pumped by the pump 18 to flow in recirculatory fashion through cooling coils (not shown) in the furnace 10 and through a coil assembly 20 in the primary heat exchanger 12. The primary coolant absorbs heat in the furnace coils and transfers that heat to the primary heat exchanger 12. A blower 22 is provided in the primary heat exchanger 12 to force air over the coil assembly 20 to cool the primary coolant liquid before it is returned to the furnace.

The cooling system of FIG. 1 also includes an air-water separator 24 interposed along the outflow line 14 upstream of the pump 18. The air-water separator includes a riser line 26 which extends to an expansion tank 28 located several meters above the separator 24. The expansion tank 28 is provided with an internal spray head 30 which receives fresh water via a supply line 32 from an external source (not shown). An output including a gas exhaust 34 and a drain 36 are also provided in the expansion tank 28.

A primary heat exchanger bypass line 38 is provided to extend between and communicated with the outflow and return lines 14 and 16 near the primary heat exchanger 12; and a bypass valve 40 is provided along the bypass line. In addition bypass control valves 42, 44, 46 and 48 are provided along the outflow and return lines 14 and 16 on opposite sides of the bypass line 38. By controlling the degree of opening of the valves 40, 42, 44, 46 and 48 some or all of the primary coolant may be made to bypass the primary heat exchanger 12.

The furnace 10 has associated electrical power equipment 50 which operates in known manner to provide proper electrical power to the furnace. This electrical equipment is also cooled by the primary coolant liquid, and for this purpose there are provided branch outflow and return lines **14*a* and 16*a* extending from cooling coils (not shown) adjacent the electrical power equipment 50, to the main outflow and return lines 14 and 16**.

An emergency cooling arrangement is also provided in the prior art cooling system of FIG. 1. This emergency cooling arrangement comprises an emergency coolant liquid supply line 52 connected to a source (not shown) of emergency coolant liquid, which may for example be a municipal water supply. An emergency cooling control valve 54 and a check valve 56 are provided in the emergency coolant liquid supply line 52 and the line 52 is connected to communicate with the return line 16. When an emergency occurs, for example when the pump 18 or the primary heat exchanger 12 fails, the emergency cooling control valve is opened and the emergency cooling liquid enters the cooling system and passes through the coils of the furnace 10 and out through the outflow line 16 to the air water separator 24. This emergency cooling liquid displaces the primary cooling liquid and forces it out of the line 16 and up through the air-water separator 24 and the riser line 26 into the expansion tank 28 from which it is discharged via the drain 36.

In order to prevent the emergency cooling liquid from flowing in the wrong direction, there is provided a one way check valve 58 in the return line 16 upstream of the emergency coolant liquid supply line 52 and another check valve 60 in the outflow branch line **14*a***.

It will be seen from the foregoing that during normal operation the primary coolant liquid recirculates within the cooling system and conveys heat from the furnace 10 to the primary heat exchanger 12 and returns to the furnace for further cooling. Also, during normal operation this coolant liquid is maintained out of contact with other liquids.

When an emergency occurs however, and the emergency cooling control valve 54 is opened the primary coolant is lost by being forced out through the drain 36 and the interior of the cooling system is exposed to the corrosion and scale producing effects of the untreated emergency cooling liquid.

Figure 2:
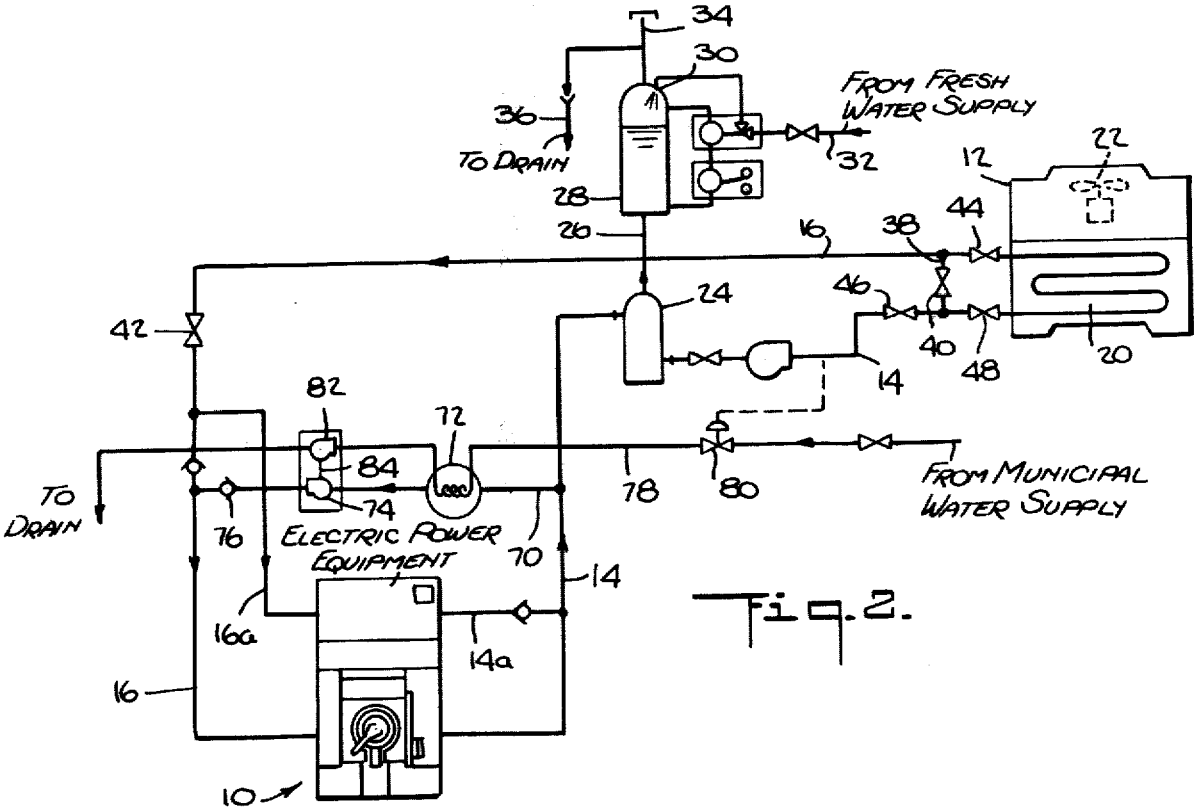
FIG. 2 is a diagram similar to FIG. 1 but showing a furnace cooling system according to the present invention.

The cooling system of the present invention, which is shown in FIG. 2, employs an emergency cooling arrangement different from that described above in connection with FIG. 1. As shown in FIG. 2 there is provided an emergency bypass conduit 70 which extends between and interconnects the furnace coolant outflow line 14 and the return line 16. An indirect water to water heat exchanger 72, an emergency coolant flow pump 74 and a check valve 76 are interposed along the emergency bypass conduit 70. An emergency coolant flow conduit 78 is also provided. One end of the conduit 78 is connected to a source of pressurized emergency cooling water such as a municipal water supply (not shown). An emergency water valve 80 is connected along the line 78. The emergency coolant flow conduit 78 extends from the valve 80 through the water to water heat exchanger 72 and through a hydraulic motor 82 to drain. The water to water heat exchanger 72 may be of any well known type and is preferably of the conventional shell and tube construction arranged so that the emergency cooling water flows through the shell while the primary coolant in the recirculation line 70 flows through the tube. The hydraulic motor 82 may be a reverse connected centrifugal pump arranged so that the emergency coolant liquid, i.e. the pressurized water from the municipal water supply, flows in through its discharge and out from its inlet. This reverse flow of water through the pump causes it to be driven like a turbine. The hydraulic motor 82 and the emergency flow pump 74 share a common rotor shaft 84. As a result, the flow of municipal water through the turbine motor 82 causes it to turn the shaft 84 which in turn drives the pump 74. The pump 74 thus recirculates the primary coolant liquid in the system through the furnace 10 and through the water to water heat exchanger 72. The primary coolant liquid is thus recooled and is recirculated back through the furnace.

It will be appreciated that the primary coolant liquid remains in the system even during an emergency situation and it is not exposed to the municipal water. At the same time the emergency coolant liquid from the municipal water supply provides cooling via the water to water heat exchanger 72. In addition, the flow energy of the emergency coolant liquid is utilized to drive the turbine motor 82 which in turn drives the pump 74 to maintain the primary coolant liquid circulating between the furnace and heat exchanger.

As can be seen in FIG. 2 the pump 74 and the check valve 76 are both arranged to drive the primary coolant liquid through the furnace 10 is the same direction that it flows during normal operation. Accordingly the cooling characteristics during emergency cooling are maintained similar to those during normal operation. It will also be noted that both the pump 74 and the motor 82 are located downstream, along their respective flows, of the heat exchanger 72. This serves to provide moderated temperatures of the liquids passing through the motor and pumps.

Figure 3:
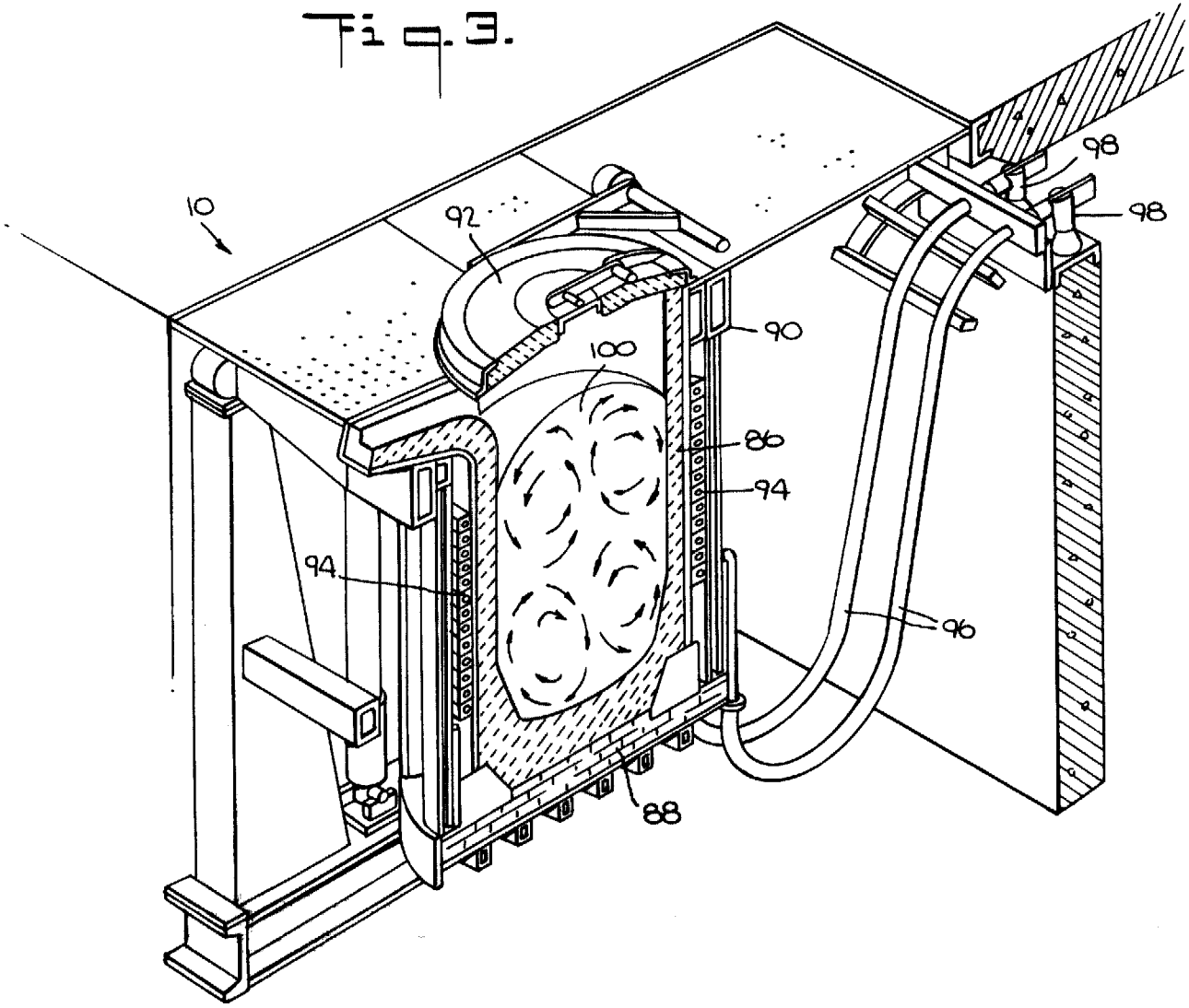
FIG. 3 is a perspective view, taken in section of an induction furnace with which the cooling system of FIG. 2 is used.

FIG. 3 shows in greater detail the induction furnace 10 of FIGS. 1 and 2. As can be seen in FIG. 3, the furnace 10 comprises a ceramic crucible 86 mounted on a base 88 inside a framework structure 90. The upper end of the crucible 86 is provided with a hinged lid 92. An induction coil 94 of hollow copper bar stock surrounds the crucible 86 and the ends of this coil are connected via power cables 96 to terminals 98. Alternating electrical current from an external source (not shown) is supplied to the terminals 98 and through the cables 96 to the coil 94. The resulting flow of current through the coil causes heating inside the crucible 86 sufficient to melt or, maintain melted, a metal charge 100 contained therein. The alternating electrical current in the coil 94 also causes magnetic fields to be generated which produce flows of the molten metal within the crucible so that a self stirring action takes place, as represented by the curved arrows in FIG. 3.

A considerable amount of heat is generated in the vicinity of the coil 94 both by conduction through the ceramic crucible 86 and from the current flow in the coil. In order to keep the coil from overheating it is formed of hollow bar stock and the primary coolant liquid is continuously flowed through it. The cables 96 are also hollow and convey coolant liquid, in addition to electrical current, to the coil 94. The cables 96 are connected to the furnace coolant outflow and return lines 14 and 16.

FIGS. 4–6 show the construction of the pump 74 and motor turbine 82 used in the system of FIG. 2. As can be seen in FIGS. 4 and 6 the coolant flow pump 74 and the turbine motor 82 each comprise a centrifugal pump and are mounted opposite ends of a common base 106. These pumps as well known per se and they may be of identical construction, although in the case of the pump serving as the motor turbine 82 a nozzle 108 is provided at what would otherwise be its discharge, the nozzle 108 forming a driving fluid inlet. As shown in FIG. 6 each of the pump 74 and the motor turbine 82 are each provided with a vaned rotor 110. These rotors are connected to opposite ends of the common rotor shaft 84. Pressurized liquid from the emergency water supply line 78 enters the turbine 82 via the nozzle 108 and turns its rotor 110 before exiting via a discharge port 112. This causes the shaft 84 to turn the motor 110 of the pump 74 which in turn draws water from the recirculation line 70 into its inlet 114 and forces it out through its outlet and around through the furnace 10.

It should be understood that any hydraulic motor or turbine can be used in place of the reverse converted pump serving as the motor turbine 84. However it has been found most economical simply to use a conventional cengtrifugal pump connected in reverse flow to provide the desired motor function.

Emergency cooling systems according to the prior art required, for a three and one half ton induction furnace, an emergency water flow rate of ten gallons per minute at approximately twenty pounds per square inch pressure. The major portion of this pressure head was expended in raising the water coming out of the furnace up to the level of the expansion tank 24 where it could be discharged via the drain 30. With the present invention however the recirculating water does not have to be pumped through this head and a flow rate of ten gallons per minute can be achieved with a pumping pressure of ten pounds per square inch. It has been found, for example, that a motor turbine as described herein can drive a centrifugal pump to deliver at the required capacity with municipally supplied water flowing at thirty gallons per minute at forty five pounds per square inch.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

For example, the invention may be applied to any electrical heating furnace requiring emergency cooling whether or not the furnace contains a molten charge.

We claim:

1. Apparatus for providing emergency cooling to electrical furnaces comprising a furnace of the type in which a primary coolant liquid flows in a closed loop through coils in the furnace and through a separate heat exchanger, a bypass conduit interconnected into said closed loop circuit for permitting at least a portion of the primary coolant liquid flowing in said circuit to bypass said separate heat exchanger, a second heat exchanger interposed in said bypass conduit, an emergency coolant flow conduit arranged to direct a flow of emergency coolant liquid through said second heat exchanger and means arranged to utilize the flow energy of said emergency coolant liquid in said emergency coolant flow conduit to drive said primary coolant liquid through said bypass conduit.

2. Apparatus according to claim 1, wherein said means arranged to utilize the flow energy of said emergency coolant liquid comprises a hydraulic motor interposed in said emergency coolant flow conduit, a pump interposed in said bypass conduit and means connecting the output of said motor to drive said pump.

3. Apparatus according to claim 2, wherein said means connecting the output of said motor to drive said pump comprises a common shaft interconnecting the rotors of said motor and said pump.

4. Apparatus according to claim 2, wherein said motor is a hydraulic centrifugal type pump connected to receive emergency coolant liquid at its discharge end.

5. Apparatus according to claim 1, wherein said second heat exchanger is of the indirect heat transfer type.

6. Apparatus according to claim 2, wherein said second heat exchanger is arranged upstream of said motor along said emergency coolant flow conduit.

7. Apparatus according to claim 1 or 2, wherein said second heat exchanger is arranged upstream of said pump along said bypass conduit.

8. Apparatus according to claim 1, wherein said pump is arranged in said emergency flow conduit to direct fluid flow through in a direction such that the primary coolant fluid flows through the furnace in the same direction as in normal operation.

9. Apparatus according to claim 3, wherein said motor and said pump are both centrifugal pumps mounted on a common support with their rotors interconnected through a common rotor shaft.

10. A method for providing emergency cooling to electrical furnaces of the type in which a primary coolant liquid flows in a closed loop circuit through coils in the furnace and through a separate heat exchanger, said method comprising the steps of directing at least a portion of said primary coolant liquid to flow through a bypass conduit to bypass said separate heat exchanger and to pass through a second heat exchanger in said bypass conduit, flowing a pressurized emergency coolant liquid through said second heat exchanger and using the flow energy of said emergency coolant liquid to drive said primary coolant liquid through said bypass conduit.

11. A method according to claim 10 wherein the step of using the flow energy of said emergency coolant liquid to drive said primary coolant liquid through said bypass conduit comprises directing said emergency coolant liquid through a hydraulic motor to turn a shaft and using the shaft rotation to drive a pump exposed to the primary coolant liquid in said bypass conduit.

12. A method according to claim 10 or 11, wherein the flow energy of said emergency coolant liquid is used to drive said coolant liquid downstream of the flow of said liquids through said second heat exchanger.

13. A method according to claim 12, wherein the primary coolant liquid is driven through said bypass conduit in a direction such that it flows through the furnace in the same direction as in normal operation.

14. A method according to claim 10, wherein said emergency coolant liquid is directed in reverse direction through a centrifugal pump and wherein the resulting rotor rotation of said centrifugal pump is used to drive another pump in said bypass conduit.

* * * * *